United States Patent [19]

Schmitt

[11] Patent Number: 5,074,705

[45] Date of Patent: Dec. 24, 1991

[54] HIGHWAY DIVIDER

[75] Inventor: Karl-Heinz Schmitt, Tholey-Hasborn, Fed. Rep. of Germany

[73] Assignee: SPIG Schutzplanken-Produktions-Gesellschaft mbH & Co. KG, Schmelz-Limbach, Fed. Rep. of Germany

[21] Appl. No.: 660,434

[22] Filed: Feb. 22, 1991

[51] Int. Cl.[5] ..... E01F 13/00; E01F 15/00

[52] U.S. Cl. ..... 404/6

[58] Field of Search ..... 404/6, 14

[56] References Cited

U.S. PATENT DOCUMENTS

| | | | |
|---|---|---|---|
| 1,175,062 | 3/1916 | Latham | 404/6 X |
| 4,040,759 | 8/1977 | Skalle | 404/6 |
| 4,307,973 | 12/1981 | Glaesener | 404/6 |
| 4,358,090 | 11/1982 | Glaesener | 404/6 X |
| 4,376,594 | 3/1983 | Prosenz | 404/6 |
| 4,641,993 | 2/1987 | Hahne | 404/6 |
| 4,665,673 | 5/1987 | Diana | 404/6 X |
| 4,806,044 | 2/1989 | Duckett | 404/6 |
| 4,869,617 | 4/1989 | Chiodo | 404/6 |
| 4,917,219 | 4/1990 | Henry | 404/6 X |

*Primary Examiner*—Ramon S. Britts
*Assistant Examiner*—Nancy P. Connolly
*Attorney, Agent, or Firm*—Toren, McGeady & Associates

[57] ABSTRACT

A highway divider including a plurality of butt-joined divider members which each has two side walls which are oppositely concavely curved in vertical cross-section. The side walls are uniformly curved over the entire height thereof. The divider members are stiffened by at least two spaced-apart transverse webs. The longitudinal edges of the side walls end tangentially in a common horizontal plane. The upper longitudinal edges of the side walls are connected to an underside of a connecting pipe which has a plug at one end thereof and plug socket on the other end.

8 Claims, 3 Drawing Sheets

HIGHWAY DIVIDER

BACKGROUND OF THE INVENTION

1. Field of the Invention

The present invention relates to a highway divider including a plurality of butt-joined divider members. Each divider member has two side walls which are oppositely concavely curved in the vertical cross-section. The side walls are connected to each other at their upper longitudinal edges.

2. Description of the Related Art

A highway divider of the above-described type is disclosed in U.S. Pat. No. 3,658,300. The divider members of the known highway divider are not coupled to each other in longitudinal direction. The side walls of the divider members are curved in accordance with a parabola function. Connected to the lower longitudinal edges of the side walls are strip-like border portions which extend in a common horizontal plane. The side walls are connected to each other only in the region of the upper edges. The positional stability of the divider members is to be provided by projections which are cut out and bent downwardly from the transition area between the horizontal strip-like border portions and the curved portions of the side walls. These projections are to be driven into the ground either by the weight of the divider members, by applying impact force or by the weight of motor vehicles which travel on the horizontal border portions.

Since the divider members are not connected to each other and the stability is effected only by the projections which can be forced into the ground, the known highway divider can only be used to a limited extent where two highway lanes are to be separated from each other or where, for example, construction sites have to be secured from an adjacent highway lane. The divider members can be displaced especially when they are placed on a hard concrete surface. In addition, a permanent longitudinal alignment of the divider members is not possible. Portions of the divider members may project at the butt-joints between the divider members which may be struck by motor vehicles, so that the divider members are then laterally displaced to an increasing extent from the desired position. Another disadvantage of the known highway divider is the fact that the divider members are connected to each other only in the upper areas of the side walls. Thus, the divider members have only a low stability against twisting. Since, moreover, the side walls are inclined relatively steeply, they are essentially only deflectors from which motor vehicles which have left the highway lanes cannot roll off relatively softly back to the highway lane.

SUMMARY OF THE INVENTION

It is, therefore, the primary object of the present invention to improve the above-described highway divider which, while having sufficient positional stability and stability against twisting, requires only a small area and still provides an excellent deflection effect.

In accordance with the present invention, the side walls of the divider members are uniformly curved over the entire height thereof. The divider members are stiffened by means of at least two spaced-apart transverse webs. The lower longitudinal edges of the side walls end tangentially in a common horizontal plane. The upper longitudinal edges of the side walls are connected to the underside of a connecting pipe which has a plug at one end thereof and a plug socket on the other end thereof.

An important feature of the present invention is the uniform curvature of the side walls of the divider members. Since highway dividers are usually used where motor vehicles travel at a relative low speed, the curvature of the side walls which gradually leads into the travel surface ensures that any motor vehicles which roll onto the side walls are automatically deflected and can softly return onto the travel surface without the danger of damage to the vehicle body. This deflection effect is a particular advantage when opposing traffic is to be separated on narrow lanes, . particularly on bridges, in the area of construction sites on superhighways. The highway divider according to the invention can also be used with advantage where divider crossovers have to be opened quickly. In addition, traffic detours in cities can be effected easily and simply when using the divider members according to the present invention. Also, temporary parking places which are safely separated from traffic can be set up without problems.

Another advantage of the highway divider according to the present invention is the fact that the divider members can be easily manipulated even though the divider members have a compact stability and can be stacked sufficiently well. Consequently, since the divider members require only a short assembly time, interference with traffic is also short. A divider member can easily be manipulated by two workmen.

The lower longitudinal edges of the side walls of the divider members can also be slightly convexly curved with a radius of curvature which is as great as possible. This prevents damage to soft travel surfaces. However, this effect can also be achieved by placing rubber coatings on the longitudinal edges of the side walls. Such rubber coatings additionally increase the coefficient of friction between the side walls and the road surface.

The connecting pipes at the top of the divider members provide a rounded upper end of the highway divider which is particularly advantageous for two-wheel vehicles, especially motorcycles. The plug and socket-type connection at the top of the divider members in axial direction of the connecting pipes contributes to an excellent alignment of the divider members, even if a motor vehicle strikes strongly against the divider member. Still, the divider members can be connected to each other through all highway curves which occur in practice.

While the plug socket of the connecting pipe may be formed directly by the open inner cross-section of the connecting pipe, the plug is a special solid or pipe material which projects beyond the end faces of the side walls. The other end face of the connecting pipe extends in the same plane as the end faces of the side walls of the divider member. Preferably, the plug is also formed by a piece of pipe which is fastened in the connecting pipe, particularly by welding. The plug may have a conical shape, so that the divider member can be better placed in curves.

Another advantage provided by the highway divider according to the present invention is the fact that street markings become unnecessary. It is possible, for example, to provide marking in the bottom portion of the side walls of the divider members. It is also conceivable to provide a white and red marking on the side walls by applying an additional PVC coating.

In accordance with another advantageous feature of the present invention, top pipes are arranged above the connecting pipes. The top pipes extend across the butt joints of two divider members and have downwardly directed locking bolts which can be inserted into vertical recesses of the connecting pipes. The top pipes serve to obtain a prescribed minimum height of the highway divider without losing the rounded upper edge of the divider. In addition, the top pipes which preferably have inner and outer diameters which are identical to those of the connecting pipes serve to connect by means of the locking bolts the divider members in a tension-proof and compression-proof manner. As a result, when the divider members are put together to form a highway divider, the connection by means of the top pipe makes it unnecessary to provide screw connections or other connections which require special tools. The top pipes and the connecting pipes overlap each other with approximately half the length thereof. In order to make it possible to place the divider members in curves, the locking bolts can be placed in the recesses of the connecting pipes with an appropriate play.

In accordance with another development of the invention, centering pins and centering sleeves extending in longitudinal direction are fastened underneath the connecting pipes at the ends of the divider members between the side walls. The centering pins and centering sleeves additionally serve to secure the alignment of all divider members integrated in a highway divider. The centering sleeves may be short pipe pieces whose inner and outer diameters correspond to the dimensions of the connecting pipes or of the top pipes. The centering pins are also pipe pieces which correspond to the plugs of the connecting pipes. Preferably, the plug sockets and the centering sleeves, on the one hand, and the plugs and the centering pins, on the other hand, are located vertically one above the other at the ends of the divider members. The centering pins and the centering sleeves are preferably fastened between the side walls by means of welding. The centering pins may also have a conical shape in order to improve the placement of the divider members in curves.

In accordance with an other feature, the locking bolts attached to the top pipes extend into corresponding vertical recesses of the centering pins and of the centering sleeves. As a result of this configuration, the stability of the highway divider is further increased and its capability of absorbing severe impacts is further improved. The locking bolts may still extend with play in the recesses of the centering pins and of the centering sleeves in order to make it possible to place the divider members in curves.

The vertical transverse webs have a triangular shape and end just below the connecting pipes and just above the plane extending tangentially along the lower longitudinal edges of the two side walls. Thus, during strong rainfalls, water can pass past the relatively thin transverse webs in both directions of the divider members. However, the transverse webs can still be provided at their lower edges with legs having horizontal surfaces which prevent the longitudinal edges of the side walls from being pressed into the roadway and improve the coefficient of friction between the roadway and the highway divider.

In accordance with another feature, discharge openings are provided in the side walls near the lower longitudinal edges thereof. As a result, water is prevented from accumulating in the base region of the side walls, so that larger water surfaces cannot be formed and the danger of aquaplaning is reduced.

The space between the side walls of the divider members can be filled with a plastic material foam, for example, polyurethane material. This provides the advantage that the coefficient of friction toward the ground is improved.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
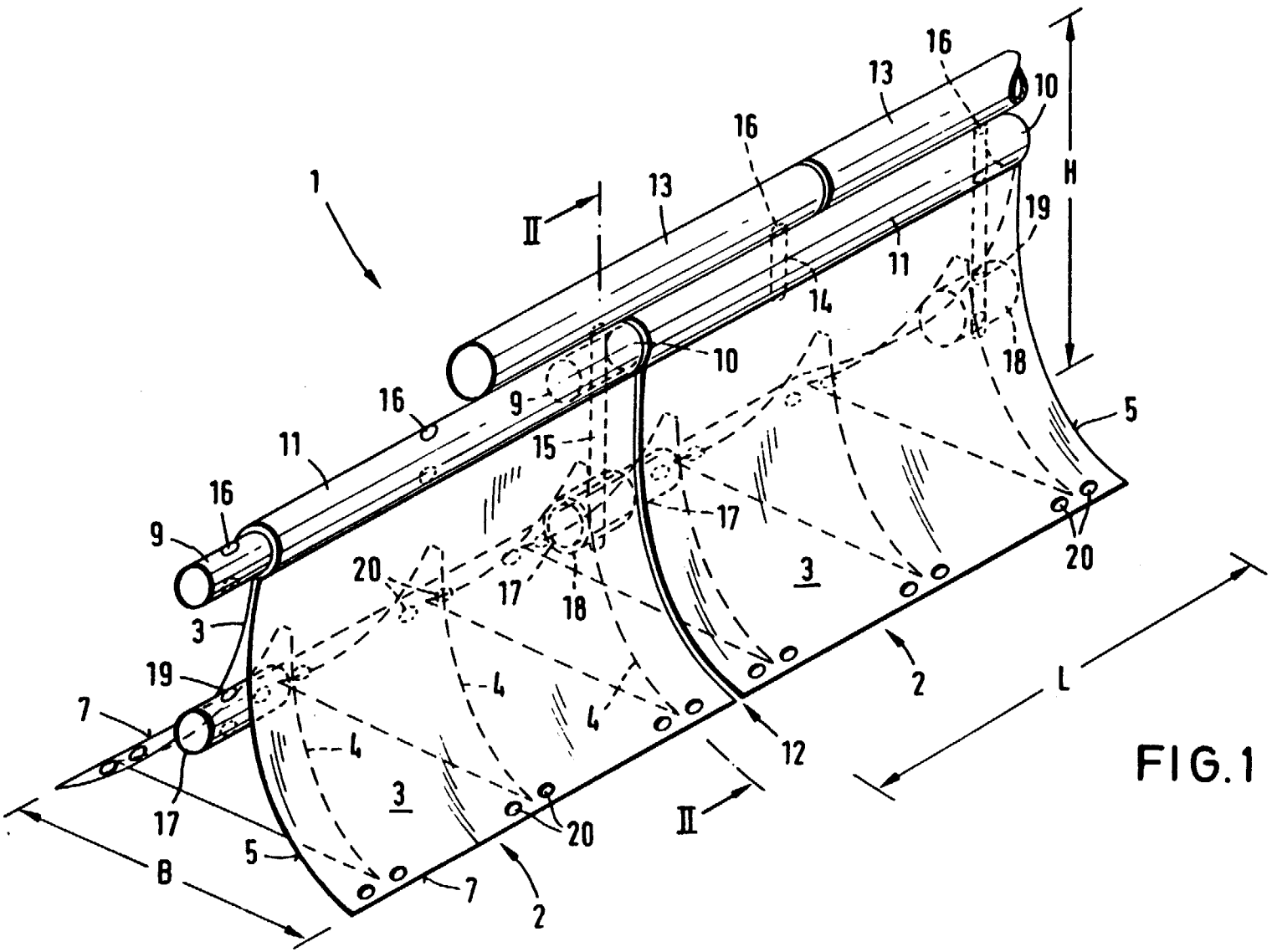
FIG. 1 is a perspective view of a portion of a highway divider according to the present invention.

In FIG. 1 of the drawing, reference numeral 1 denotes a portion of a highway divider as it is used, for example, for separating opposing traffic on narrow lanes in the area of a construction site of a superhighway.

Figure 2:
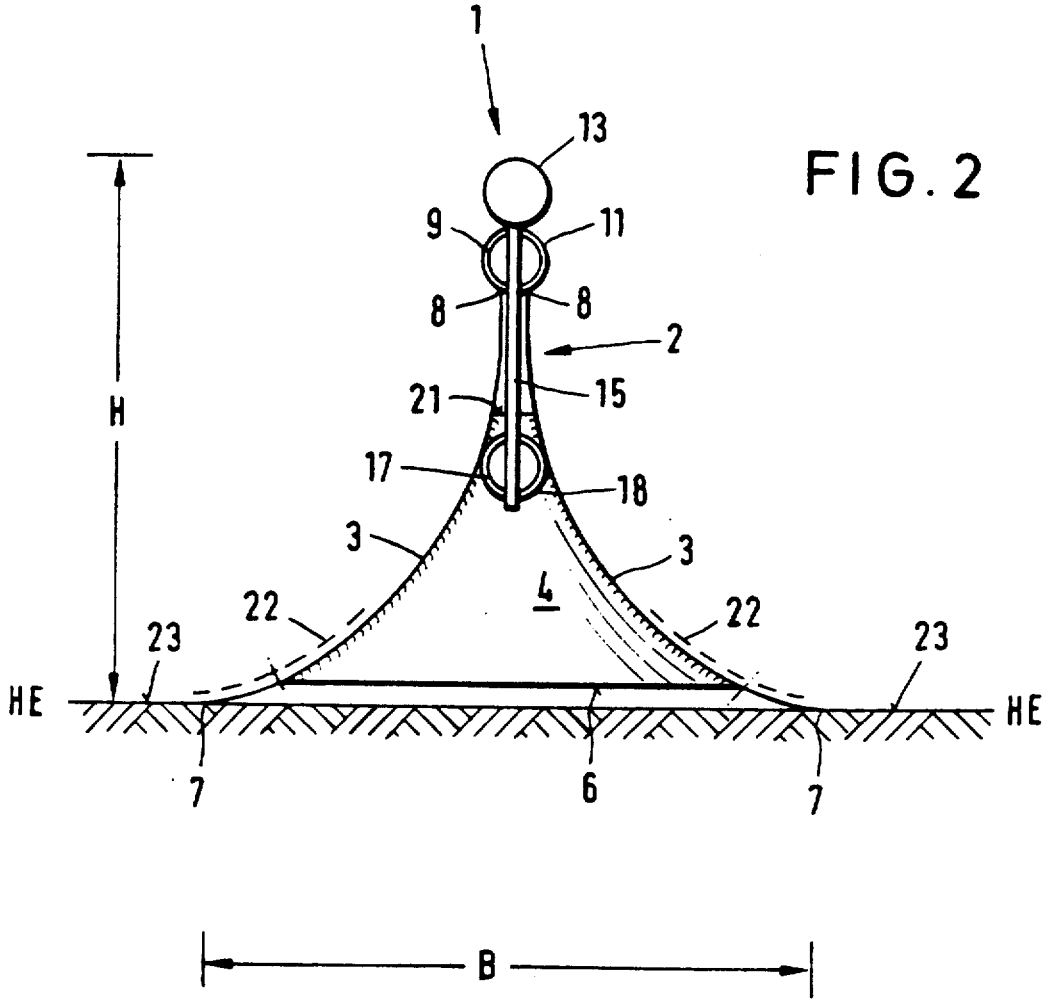
FIG. 2 is a sectional view of the highway divider of FIG. 1 taken along sectional line II—II.

The highway divider 1 is composed of butt-joined divider members 2 of identical construction. The divider members may have a length L of, for example, 2000 mm. As also shown in FIG. 2, the divider members have a total height H and a maximum width B each of about 500 mm.

As shown in the drawing, each divider member 2 has two side walls 3 which are oppositely concavely curved in the vertical cross-section. The side walls 3 are uniformly curved over the entire height thereof, i.e., they have an identical radius. The divider members 2 are stiffened by means of three spaced-apart vertically arranged triangular transverse webs 4. The transverse webs 4 are arranged approximately in the middle of the length of the divider member 2 and at a short distance from the two end faces 5 of the side walls 3. The transverse webs 4 are connected to the side walls 3 by means of welding. As can be seen particularly in FIG. 2, the transverse webs 4 end with their lower longitudinal edges 6 just above the plane HE which extends tangentially to the longitudinal edges 7 of the two side walls 3.

Thus, the lower longitudinal edges 7 of the side walls 3 end tangentially in the common horizontal plane HE which also forms the roadway surface. The upper longitudinal edges of the side walls 3 are connected by welding to the bottom side of a connecting pipe 11. The connecting pipe 11 has at one end thereof a plug 9 formed by a piece of pipe and at the other end a plug socket 10 formed by the internal diameter of the pipe. The length of the coupling pipe 11 corresponds to the length of a divider member 2. The plug 9 projects beyond the end faces 5 of the side walls 3.

Top pipes 13 which bridge the butt joints 12 of two divider members 2 are provided above the connecting pipes 11 which can be connected to each other in longitudinal direction. The cross-section of the top pipes 13 corresponds to that of the connecting pipes 11. The top pipes 13 also have a length which corresponds to the length L of the divider members 2 or the connecting pipes 11. The top pipes 13 are provided with downwardly directed locking bolts 14, 15. These locking bolts 14, 15 may be of solid material or of pipe material.

The connecting pipes 11 have vertical recesses 16 in the region of the plugs 9, of the plug sockets 10 and in the region between the plugs and plug sockets. The recesses 16 have a cross-sectional size which corresponds to the locking bolts 14, 15.

As FIGS. 1 and 2 also show, centering pins 17 and centering sleeves 18 extending in longitudinal direction are fastened at the ends of the divider members 2 in the region underneath the connecting pipes 11. The centering pins 17 and centering sleeves 18 are fastened particularly by welding. The centering pins 17 and the centering sleeves are formed by pipe pieces. They correspond in their cross-section to the plug 9 and the plug socket 10 of the connecting pipe 11. They have such a length that the centering pin 17 can be inserted without problems into the centering sleeve 18 of an adjacent divider member 2, so that they ensure the axial alignment of the divider members 2 together with the connecting pipes 11.

As shown in FIG. 1, the locking bolts 14, 15 of the top pipes 13 have different lengths. The locking bolts 15 arranged in the region of the plug 9 and plug socket 10 have such a length that they extend also through corresponding vertical recesses 19 in the centering pins 17 and the centering sleeves 18.

As FIG. 1 further shows, discharge bores 20 are arranged on both sides of the transverse webs 4 near the lower longitudinal edges 7 of the side walls 3. Water can flow off through these discharge openings 20.

As can be seen in FIG. 1 and in FIG. 2, the transverse webs 4 end with their upper edges 21 just underneath the connecting pipes 11.

Figure 3:
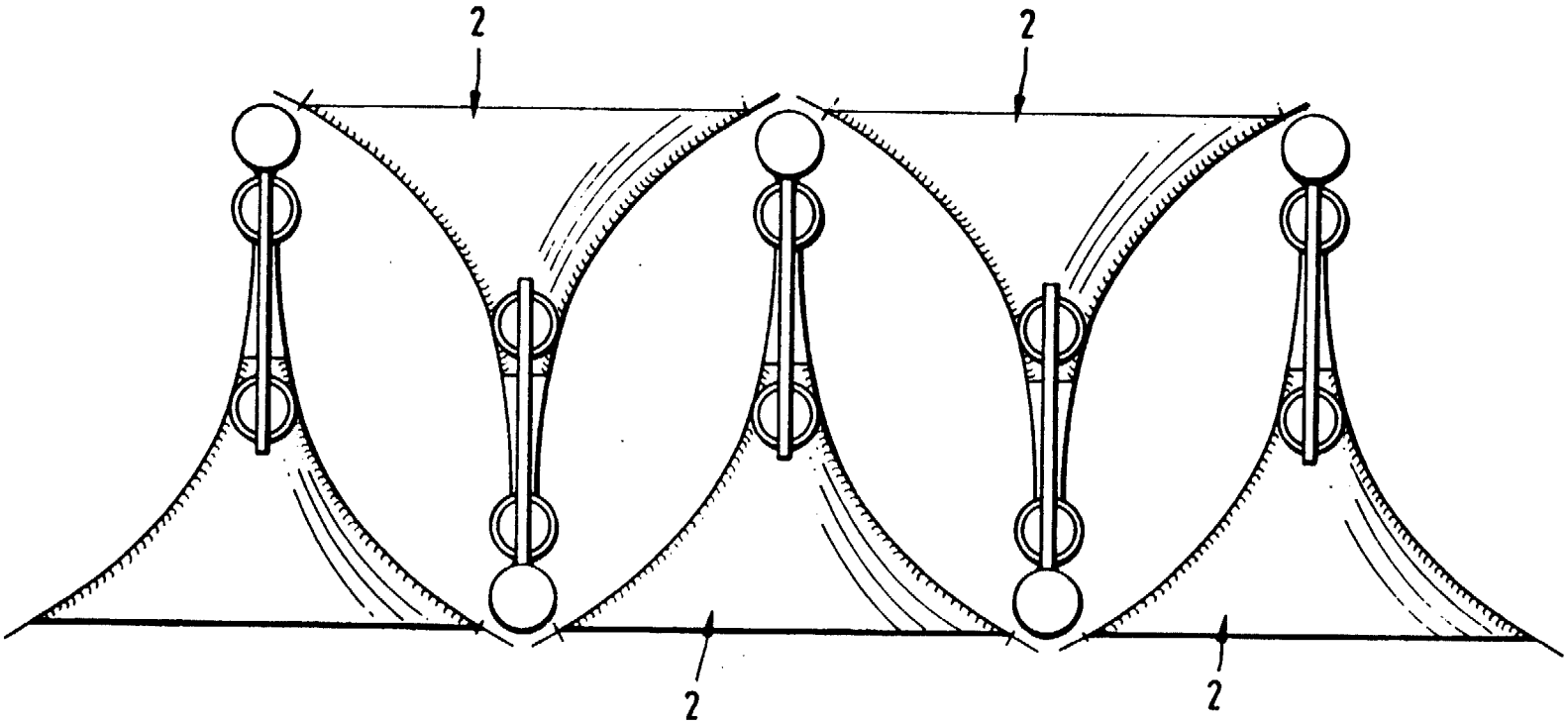
FIG. 3 is a sectional view showing divider members being stacked for transport.

As FIG. 3 shows, the divider members 2 can be stacked well. For this purpose, two divider members 2 are arranged next to each other and a third divider member 2 is turned by 180° about its longitudinal axis and is then placed from the top between the two divider members 2.

Finally, as shown in FIG. 2, longitudinal or transverse markings 22 in the form of at least one adhesive tape or of a fixedly attached granular material can be provided in the bottom area of the side walls 3. For example, the granular material on the side walls 3 may have the same properties as the roadway 23 next to highway divider.

While a specific embodiment of the invention has been shown and described in detail to illustrate the application of the inventive principle, it will be understood that the invention may be embodied otherwise without departing from such principles.

I claim:

1. In a highway divider including a plurality of butt-joined divider members, wherein each divider member has two side walls which are oppositely concavely curved in vertical cross-section, the side walls having upper and lower longitudinal edges and being connected to each other at the upper longitudinal edges, wherein the improvement comprises that the side walls of the divider members are uniformly curved over the entire height thereof, at least two spaced-apart transverse webs mounted between the side walls being connected to the side walls for stiffening the divider members, the lower longitudinal edges of the side walls ending tangentially in a common horizontal plane, the upper longitudinal edges of the side walls being connected to an underside of a connecting pipe, the connecting pipe having a plug at one end thereof and a plug socket on the other end thereof.

2. The highway divider according to claim 1, further comprising the top pipes arranged above the connecting pipes, each top pipe extending across a butt joint of two divider members, the connecting pipes having vertical recesses, the top pipes having downwardly directed locking bolts for insertion into the vertical recesses of the connecting pipes.

3. The highway divider according to claim 2, comprising centering pins and centering sleeves extending in longitudinal direction, the centering pins and centering sleeves being mounted at the ends of the divider members between the side walls.

4. The highway divider according to claim 3, wherein the centering pins and the centering sleeves have corresponding vertical recesses, the locking bolts extending through the vertical recesses.

5. The highway divider according to claim 1, wherein the vertical transverse webs are triangularly shaped, the transverse webs having an upper edge located a short distance underneath the connecting pipes and a lower edge located a short distance above the common horizontal plan extending tangentially with the lower longitudinal edges of the two side walls.

6. The highway divider according to claim 1, wherein the side walls have discharge openings near the lower longitudinal edges.

7. The highway divider according to claim 1, wherein the space between the side walls is filled with a foamed plastic material.

8. The highway divider according to claim 7, wherein the foamed plastic material is polyurethane.

* * * * *